United States Patent [19]

Davis

[11] Patent Number: 4,841,418

[45] Date of Patent: Jun. 20, 1989

[54] EXPLOSION-PROOF FIXTURE AND METHOD

[75] Inventor: Dwayne Davis, Lee County, Miss.

[73] Assignee: Emerson Electric Co., St. Louis, Mo.

[21] Appl. No.: 87,760

[22] Filed: Aug. 21, 1987

[51] Int. Cl.[4] ..... F21Y 15/00

[52] U.S. Cl. ..... 362/223; 362/219; 362/376

[58] Field of Search ..... 362/217, 219, 223, 224, 362/225, 376, 378, 404, 260, 267, 390, 249

[56] References Cited

U.S. PATENT DOCUMENTS

| | | | |
|---|---|---|---|
| 3,014,680 | 12/1961 | Steinbach | 362/225 |
| 3,808,495 | 4/1974 | Win | 362/223 |
| 4,262,327 | 4/1981 | Kovacik et al. | 362/223 |
| 4,435,744 | 3/1984 | Russo | 362/225 |
| 4,454,569 | 6/1984 | Maguire | 362/249 |
| 4,782,430 | 11/1988 | Robbins et al. | 362/267 |

FOREIGN PATENT DOCUMENTS

| | | | |
|---|---|---|---|
| 578970 | 6/1933 | Fed. Rep. of Germany | 362/223 |

*Primary Examiner*—Ira S. Lazarus

*Assistant Examiner*—Richard R. Cole

*Attorney, Agent, or Firm*—Polster, Polster and Lucchesi

[57] ABSTRACT

An explosion-proof fixture generally with a ballast or wire housing has an end housing having inner annd outer walls defining a chamber, aligned openings in the inner and outer walls, and a transparent sleeve having an open end, mounted in the opening in the inner wall. The sleeve is slideable through the openings in the inner and outer walls, and mountable and demountable therethrough. A lamp is mounted within the sleeve. The lamp has a socket on it. The socket is mounted on a bracket assembly which in turn is mounted on a retainer mounted in or on the inner wall of the end housing. The fixture is assembled by first fastening an end housing to one end of an elongated ballast housing, passing an end of the sleeve through the opening in the inner wall of the end housing, sealing the perimeter of the sleeve in the opening adjacent an open end of the sleeve, inserting into the sleeve the lamp mounted on the bracket assembly, and thereafter mounting the bracket assembly on the retainer mounted on or in the inner wall of the end housing.

14 Claims, 3 Drawing Sheets

EXPLOSION-PROOF FIXTURE AND METHOD

BACKGROUND OF THE INVENTION

Four-lamp explosion-proof fluorescent fixtures presently in common use have four transparent glass sleeves, each of which surrounds one fluorescent lamp. Each sleeve is conventionally flared at both ends, and rests against a shoulder integral with a wall of an end housing at each end of the fixture. This sleeve is cemented into an aperture inboard of the shoulder in the long dimension of the fixture, while the unconnected end housings are held in a jig or fixture, and a ballast housing is fastened to and between the two end housings after the sleeves have been cemented. Although such conventional fixtures can be relamped through the open ends of the sleeves, if one of the sleeves must be replaced, all of the sleeves have to be broken. The conventional explosion-proof fluorescent fixtures use a standard forty-eight inch tube, which makes the lamp fixture about fifty-two inches overall in length.

One of the objects of this invention is to provide an explosion-proof fixture in which a single sleeve can be replaced without breaking either that sleeve or any other sleeve in the fixture.

Another object is to provide such a fixture that permits preassembly of two end housings and one or more ballast or wire housings before the sleeve is mounted.

Still another object is to provide such a fixture that is more compact, providing greater lumen output in a smaller fixture, than fixtures known heretofore.

Still another object is to provide such a fixture that is easy to assemble and strong compared with explosion-proof fluorescent fixtures known heretofore.

Other objects will become apparent to those skilled in the art in the light of the following description and accompanying drawing.

SUMMARY OF THE INVENTION

An explosion-proof fixture has an end housing having inner and outer walls defining a chamber, openings in the inner and outer walls, and a transparent sleeve having an open end, mounted in the opening in the inner wall. The sleeve is slideable through the openings and mountable and demountable therethrough. An elongated lamp is mounted within the sleeve. The lamp has a socket on one end of it. The socket is mounted on a bracket assembly which, in the preferred embodiment, in turn is mounted on a retainer that is mounted in or on the inner wall of the end housing. The fixture is assembled by passing an end of the sleeve through the opening in the inner wall of an end housing, sealing the perimeter of the sleeve in the opening adjacent an open end of the sleeve, mounting the lamp at its socket end on the bracket assembly, and, in the preferred embodiment, in which a biaxial lamp is used, with spaced legs bridged by the socket, attaching a clip thereto, inserting into the sleeve the lamp mounted on the bracket assembly, and thereafter mounting the bracket assembly on the inner wall of the end housing, preferably by fastening it to the retainer mounted on or in the inner wall.

DESCRIPTION OF THE PREFERRED EMBODIMENT

Figure 1:
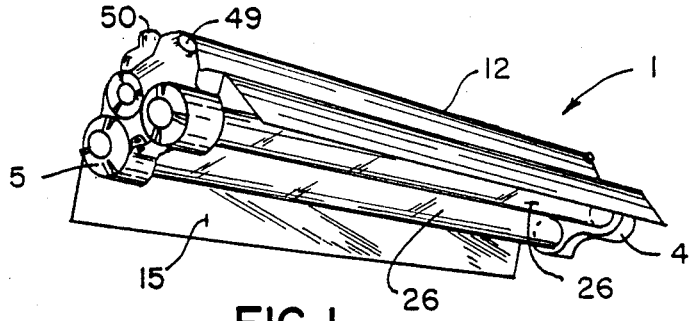
FIG. 1 is a view in perspective of one embodiment of explosion-proof fluorescent fixture of this invention.

Referring now to the drawing for one illustrative embodiment of explosion-proof fluorescent fixture of this invention, reference numeral 1 indicates a completed fixture. The fixture 1 has two end housings 4 and 5, each with an internally threaded conduit nipple boss 7. In the illustrative embodiment shown, the end housings 4 and 5 are mirror images of one another, each with an outer end wall 40 with heavy sections 41 through which outer sleeve openings 42 and 44 and a ballast wiring opening 46 extend. The openings 42, 44 and 46 are circular in end elevation, and are defined by a threaded surface. The end wall has a top wall section 48, through which wiring openings 49 extend and from which a support boss 50 projects. The end housings also have an inner wall 52 with an integral cylindrical collar 53 with a threaded section 54 and a channel section 55 with a channel 56 in it, the sections 53 and 55 together defining an inner sleeve-receiving opening 57. The inner wall 52 has, at its upper end as viewed in FIG. 2, a step 60, and an inboard outer face 59, from which the nipple boss 7 projects. The inner and outer walls define a chamber 65, which, when the various openings are closed after wiring is completed and the fixture is lamped, is isolated from the ambient atmosphere.

Figure 2:
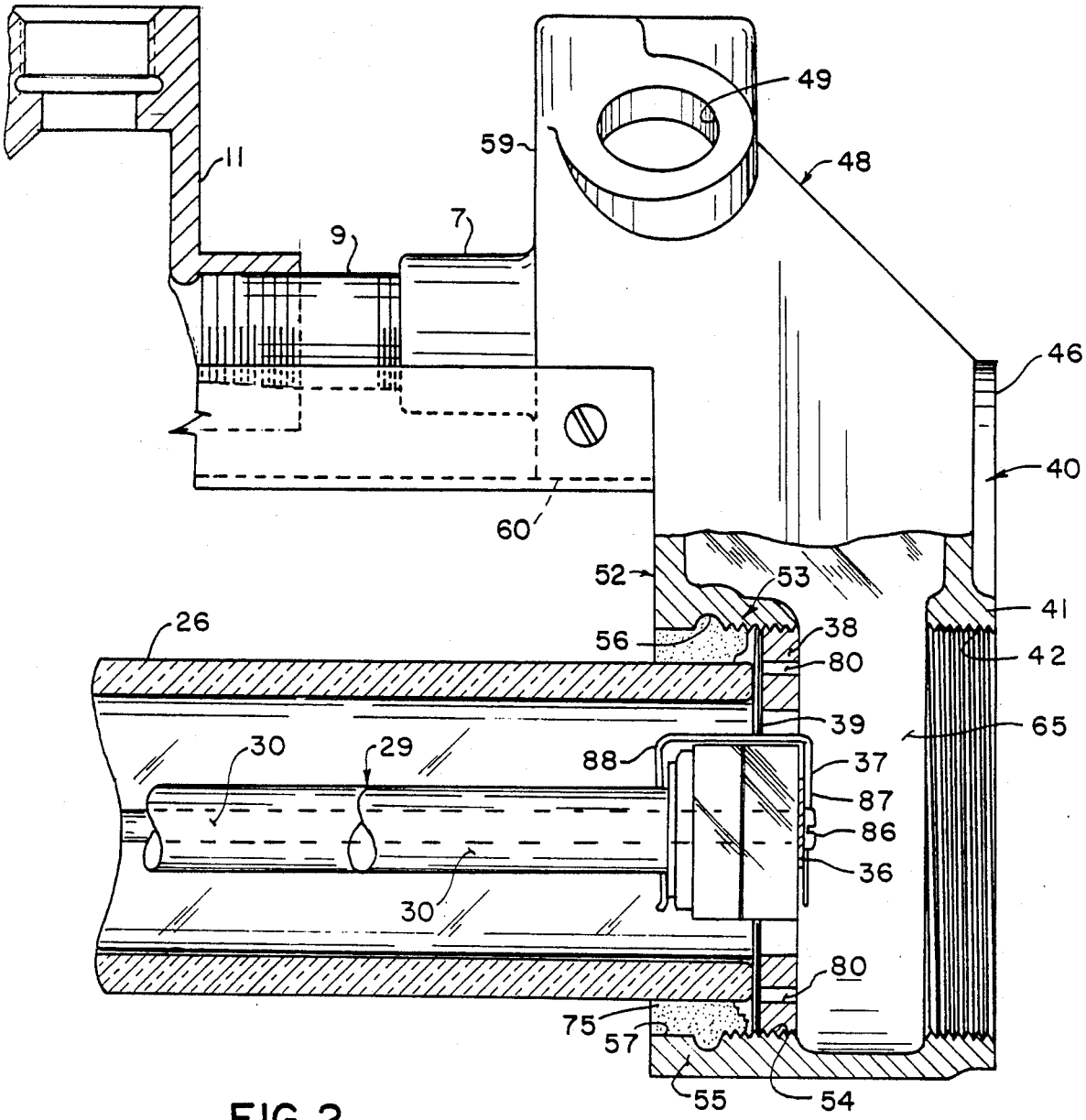
FIG. 2 is a fragmentary enlarged sectional view, partly broken away, of one end of the fixture shown in FIG. 1.
Figure 3:
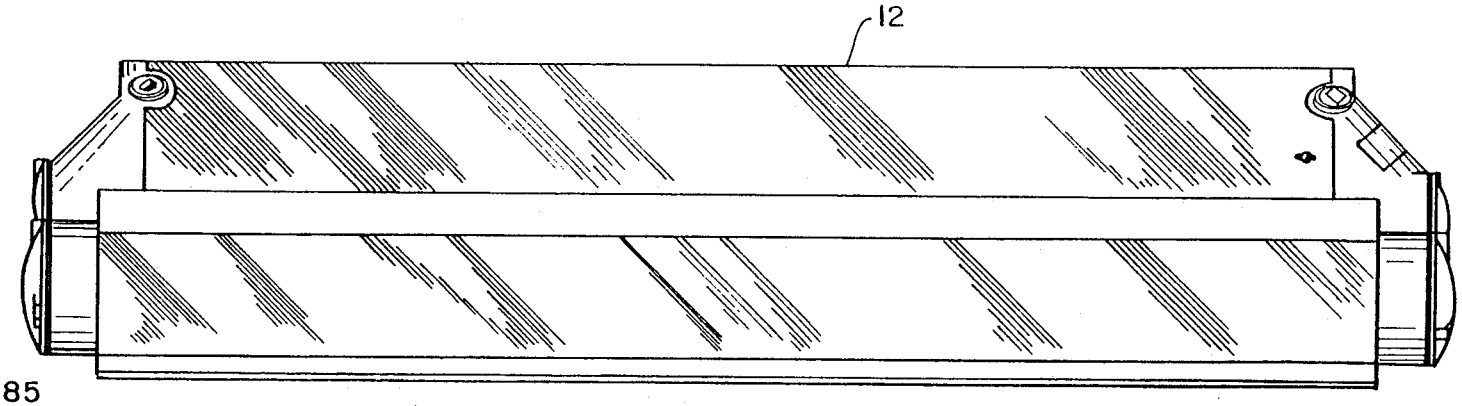
FIG. 3 is a view in side elevation of the device shown in FIG. 1, enlarged with respect to FIG. 1 and reduced in respect of FIG. 2.
Figure 18:
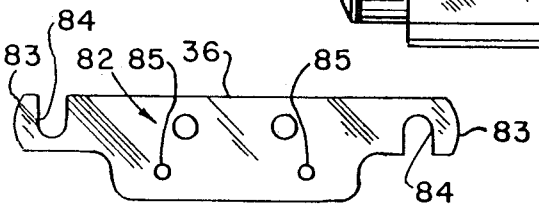
FIG. 18 is a view in front elevation of a bracket assembly plate.
Figure 10:
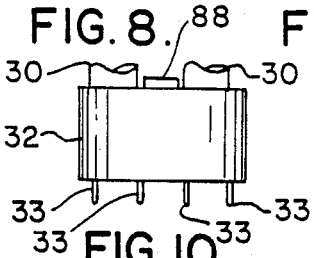
FIG. 10 is a bottom plan view of a socket, with legs of a biaxial lamp shown fragmentarily, and an end of a clip leg shown as it will appear when the lamp and socket are assembled on a mounting bracket.
Figure 14:
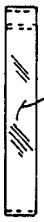
FIG. 14 is a top plan view of a clip that in use embraces the socket and receptacle, as shown in FIG. 2.
Figure 15:
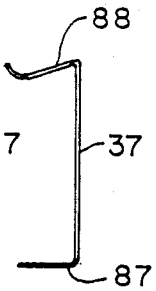
FIG. 15 is a view in side elevation of the clip of FIG.14.
Figure 11:
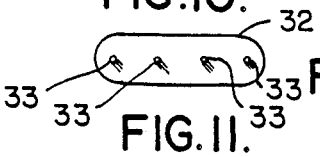
FIG. 11 is a view in end elevation of the socket shown in FIG. 10.
Figure 16:
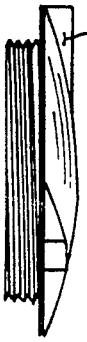
FIG. 16 is a view in side elevation of an outer wall closure.
Figure 17:
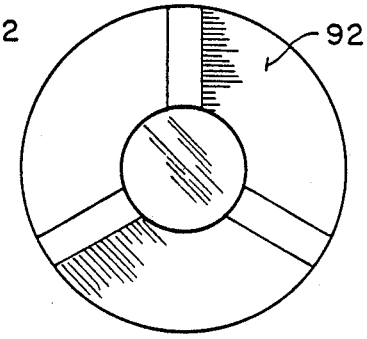
FIG. 17 is a view in front elevation of the closure shown in FIG. 16.
Figure 12:
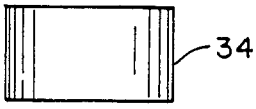
FIG. 12 is a top plan view of a receptacle that receives male terminal pins of the socket shown in FIGS. 10 and 11.
Figure 13:
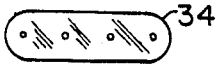
FIG. 13 is a view in end elevation of the receptacle shown in FIG. 12.

A conduit-nipple 9 is threaded into the boss 7 of each end housing at one end of the nipples. The conduit-nipples 9 are threaded at their other ends into internally threaded nipple bosses of a ballast housing or module 11. There may be one or a plurality of ballasts and ballast modules, the ease of provision of more than one being a virtue of the fixture of this invention. A ballast hood 12 is mounted on and extends between the end housings. In conventional fixtures, the ballast hood may serve the structural function of joining the end housings; in the fixture of this invention, it primarily serves to provide a finished appearance. A reflector 15 is mounted below the hood 12 and above sleeves 26 which extend between the end housings 4 and 5. Lamps 29 are mounted within the sleeves 26. In the present embodiment, the lamps are biaxial lamps, with two legs 30, connected at one end by a reach 31 integral with the legs, and connected at their free ends by a socket 32 mounted on and extending between the legs. The socket 32 has electric terminal prongs 33 projecting from the side opposite the lamps 30, which are received in complementary female terminals in a receptacle 34. Provision is made on the outboard side of the receptacle 34 for the connection of the usual electrical conductors from the ballast, which is conventional, and for the reception of mounting screws 86. Near the reach 31, the lamps are supported by plastic cradles 91. The socket 32 and receptacle 34, secured against accidental separation by a clip 37, an outer leg 87 of which engages an outer surface of the receptacle 34, and an inner leg 88 of which engages an inboard surface of the socket 32 between the legs 30, as shown in FIGS. 2 and 10, are mounted on a bracket 36. The bracket 36 is, in this embodiment, a generally flat plate with a pair of wings 83, through which screw-receiving slots 84 extend. Screw holes 85, in the center web of the bracket 36, receive the screws 86, extending into the complementary holes in the receptacle 34, to mount the receptacle 34 to the bracket. The bracket 36 is, in turn, mounted on a retainer 38. In this embodiment, the retainer 38 is in the form of an annular plate with four, equi-spaced, internally threaded holes 80 extending through it from one flat side to another. The plate has a threaded outer perimetric surface 81, complementary to the threaded section 54 of the collar 53.

As can be observed from FIG. 2, the sleeve 26 can pass readily through the openings 42 and 57. They can, therefore, be cemented into place with conventional cement 75, after the housings have been securely threaded to the ballast module or modules 11.

A gasket 39 is positioned with one flat side against the surface defining the open mouth of the outer end of the sleeve 26, and on its other flat side, engages an inboard flat side of the retainer 38. The bracket 36 is mounted on the retainer 38 by means of screws, extending through the slots 84 and into the internally threaded holes 80 of the retainer.

In assembling the fixture of this invention, the end housings 4 and 5 are threaded onto the nipples 9, which have already been mounted in the ballast module or modules 11. The sleeves 26 are slid through the openings 42 and 57 to the position shown in FIG. 2. Gaskets 39 are put into place, and the retainers 38 are screwed down to hold the sleeves in place. Each retainer 38 is turned until two, diametrically opposite, holes 80 are substantially horizontal, the resilience of the gasket 39 permitting the adjustment, which will never be more than one-eighth of a turn. Cement 75 is then forced into the space around the end of the sleeve between the sleeve and the inside surface of the section 55 of the opening 57, as shown in FIG. 2, the channel 56 serving to key the cement in place. The cement 75 is allowed to set. The cradles 91 are mounted on the outer ends of the lamps. The receptacle 34 is mounted to the bracket 36, the socket prongs 33 are inserted in the female terminals in the receptacle 34, the clip 37 is pushed into place, and the lamps are inserted into the sleeves 26 until the bracket wings 83 meet the outer flat surface of the retainer 38. The bracket is then screwed to the retainer. The required wiring is accomplished in the conventional way. The hood 12 is put into place with suitable screws, covers 92, of conventional construction and appropriate size are screwed snugly into the openings 42, 44 and 46, the wiring openings 49 are plugged, so that the chamber 65 is effectively isolated from the ambient atmosphere, and the fixture is ready for hanging.

It can be seen that relamping can be accomplished easily by unscrewing the appropriate cover 92, loosening the screws that hold the bracket 36 to the retainer, and pulling the lamp out. If a sleeve is to be replaced, the lamps are first removed, the cement 75 is chipped out or otherwise removed, and the sleeve is pulled out through the opening 42. In this way, a single sleeve can be replaced without disturbing the other sleeve or sleeves.

Figure 4:
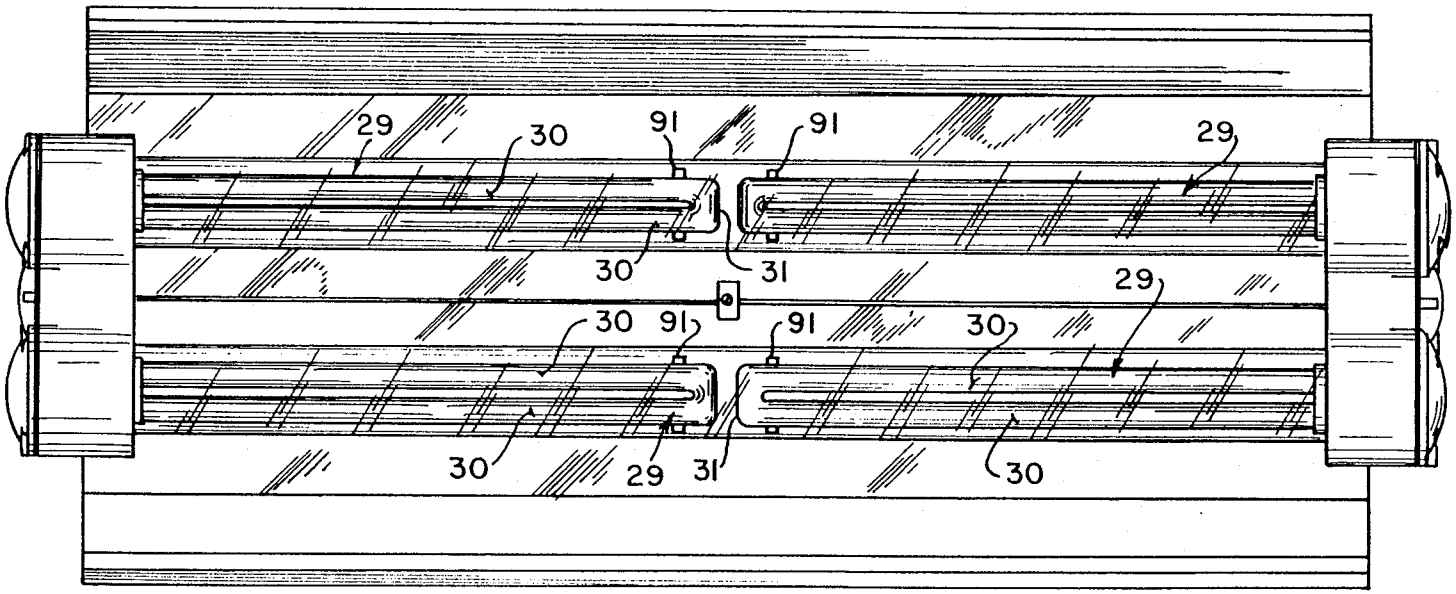
FIG. 4 is a bottom plan view of the device as shown in FIG. 3.

By using a pair of biaxial lamps in a single sleeve, as shown particularly in FIG. 4, it is possible to obtain almost twice the lumen output of a standard 48 inch tube, in a fixture only 37 inches long as compared with the standard 52 inch unit. The construction of the fixture of this invention permits running wiring into both end housings from one or a plurality of ballast modules. The use of multiple ballasts permits one or more to be switched off to conserve energy, when the lighting level can appropriately reduced. As has been indicated in the description of the fixture and of its assembly, the construction of fixture of this invention requires no special joints, ground surfaces, or special external fixturing during the assembly. The joining of the end housings by threading them to the ballast housing before the sleeves are installed, provides a much stronger construction than the conventional construction used herefore.

Figure 5:
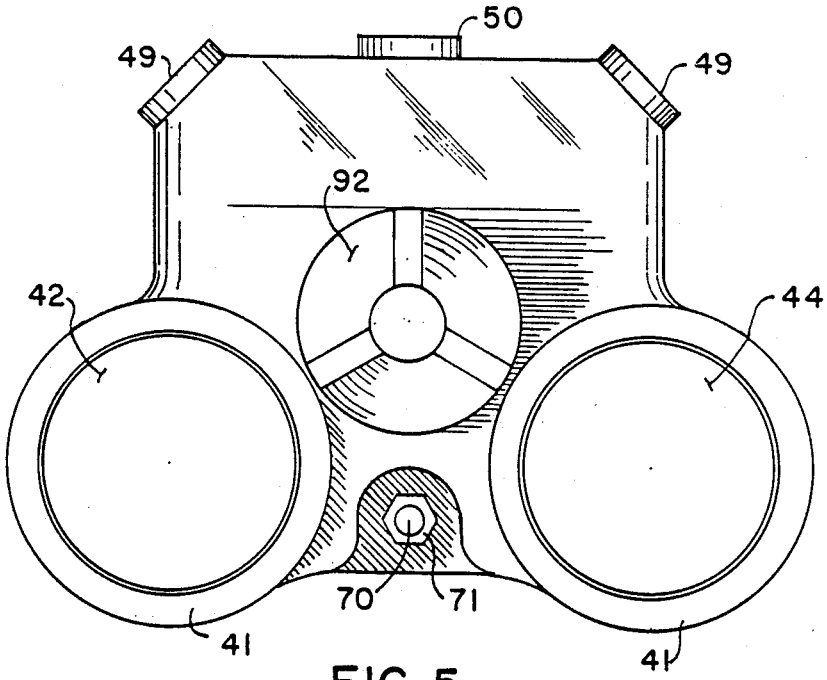
FIG. 5 is a view in end elevation of the device as shown in FIGS. 3 and 4.
Figure 6:
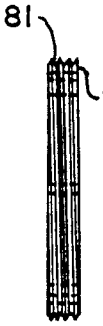
FIG. 6 is a view in side elevation of a retaining ring.
Figure 7:
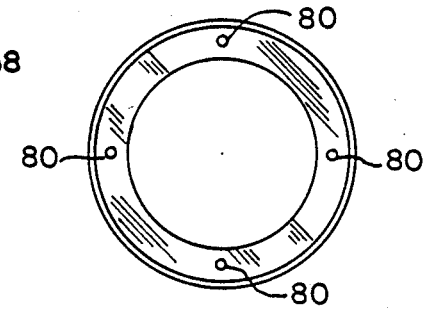
FIG. 7 is a view in front elevation of the retaining ring shown in FIG. 6.
Figure 8:
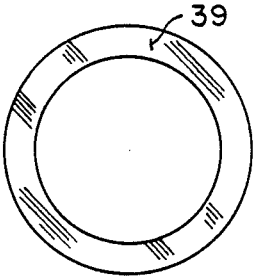
FIG. 8 is a view in front elevation of a gasket.
Figure 9:
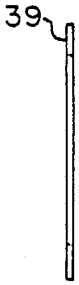
FIG. 9 is a view in side elevation of the gasket shown in FIG. 8.

Numerous variations in the construction and method of assembly of the fixture of this invention, within the scope of the appended claims, will occur to those skilled in the art in the light of the foregoing disclosure. Merely by way of example, the bracket can assume shapes different from the flat plate shown in the illustrative embodiment, such as a winged U shape to position the lamp farther into the sleeve, or with a circular section to serve the holding function of the retainer, which can then be eliminated if other means for mounting the bracket plate in or on the inner wall are provided. In that case, the retaining means may take the form of screws or bolts or other fastening means cooperating with complementary means on or in the inner wall. The retainer can be mounted to the inner wall of the end housing in other ways, as by forming the retainer in the manner of a follower in packing gland construction, with a barrel part and a flange that can be bolted to the inner wall. If the span were such or the conduit or rod (both being intended to be embraced within the term "pipe" as used in the claims) were such that the end housings were not adequately supported against rocking away from one another, then, as suggested in FIG. 5 by way of illustration, a hole in a solid section of each of the end housings 4 and 5 can be provided to receive a threaded end of a tie rod 70 which projects beyond the outboard surface of the housings. A nut 71 on each end of the tie rod 70 can be snugged to support the lower parts of the end housings from rocking away from one another until the sleeve is completely cemented into place, when the rod can be removed. A single lamp in a sleeve that is either closed at its inboard end and cantilevered from its open end, or merely supported by a housing or bracket at its outer end, or conversely, a multiplicity of sleeves and biaxial or other lamps can be used. Although biaxial lamps have distinct advantages, elongated incandescent lamps, or standard straight tube fluorescent lamps, or other lamps, single- or multi-axial, can be used, as long as they can be mounted within the sleeve, because the fixture of this invention will have great utility in permitting replacement of the sleeves and the pre-assembly of the end housings. When incandescent lamps are used, either a wiring module can be employed instead of a ballast module, or no module can be employed, the basic frame structure with two end housings then being the pipe to the ends of which the end housings are mounted by threading or otherwise. The term "module" is used in the claims to encompass either a ballast housing or module or a wiring housing or module. Whenever one or more threaded pipes are used with or without intervening modules, the two extreme ends can either be oppositely threaded (right and left hand threads) and the nipple-receiving bosses correspondingly threaded, or an explosion-proof union can be used, or, if the ends are threaded the same way, one housing can be rotated around the pipe to screw it down. The sleeve can be translucent, as, for example, frosted, rather than transparent, but will, in any case, be light transmitting. Other means for mounting the sleeve, besides the cement 75, can be used where permitted by the codes. For example, a snug fitting annular elastomeric gasket or 0-ring could be used. The tube can be flared at one or both ends, or even flanged, as long as the flared or flanged end passes readily through the opening in the inner wall of the end housing. As has been suggested, the bracket assembly can be mounted directly to the inner wall, as by screws extending into blind passages in the inner wall or bosses on the inner wall, or by clips or nuts on pins projecting from the inner wall. These are merely illustrative.

What is claimed is:

1. An explosion-proof fixture comprising an end housing, said end housing having inner and outer walls defining a chamber, openings in said inner and outer walls, a light transmitting sleeve having an open end mounted in said inner wall opening, said sleeve being slideable through said openings and mountable and demountable therethrough, a lamp mounted within said sleeve, said lamp having socket means on an end thereof, retaining means on said inner wall, and bracket assembly means, connected to and supported by said retaining means, for mounting said lamp within said sleeve.

2. The device of claim 1 wherein said retaining means comprises an annular plate externally threaded on a perimetric surface, said housing inner wall opening being defined at least in part by an internally threaded surface complementary to said externally threaded perimetric surface, said annular plate being threaded into said opening.

3. The device of claim 2 wherein the bracket assembly includes a bracket plate demountably mounted to said retainer means annular plate, and a generally U-shaped lamp clip, one leg of which engages the said bracket plate and the other leg of which extends over and into engagement with a surface of said socket.

4. The device of claim 2 including gasket means extending along and outboard of said open end of said sleeve, between the said retainer sand the open end of said sleeve.

5. The device of claim 1 wherein said fixture includes a ballast housing to which said end housing is connected, said lamp is a biaxial fluorescent lamp, and said socket means bridges the ends of two, spaced legs of said biaxial fluorescent lamp.

6. The device of claim 1 including two, facing, end housings.

7. The device of claim 6 wherein the two end housings are joined by pipe.

8. The device of claim 7 wherein the said pipe is in sections, with at least one module connected intermediate the ends of said pipe.

9. The device of claim 7 wherein the pipe is externally threaded at its ends and said end housings have internally threaded end-receiving bosses threadedly receiving said pipe ends.

10. An explosion-proof fluorescent fixture comprising a module having pipe mounted on and projecting in opposite directions from it, said pipe being threaded at its outer ends, end housings having internally threaded nipple receiving means for threadedly receiving said pipe threaded ends, by which said end housings are joined to said module and to one another, each of said end housings having inner and outer walls, openings in said inner and outer walls, a light-transmitting sleeve having an open end mounted in said inner wall opening, said sleeve being of a size to be slidable through said openings and mountable and demountable therethrough, an elongated lamp mounted within said sleeve, retaining means on said inner wall, and bracket assembly means, connected to and supported by said retaining means, for mounting said lamp within said sleeve.

11. The fixture of claim 10 including a biaxial lamp mounted within the sleeve, said lamp having socket means on and bridging two ends thereof, said bracket assembly means comprising a bracket plate, a receptacle mounted on said bracket plate, said receptacle having terminals complementary to terminals on said socket means and engaging them in electrical and mechanical connection, clip means embracing said bracket plate and socket, and means for mounting said bracket assembly on said inner wall.

12. The method of assembling an explosion-proof fluorescent fixture comprising first fastening an end housing to one end of a module, said end housing having inner and outer walls defining a chamber and openings in said inner and outer walls of a size admit the passage of a light-transmitting sleeve through them mounting a light-transmitting sleeve in said inner wall by passing an end of said sleeve through said inner wall opening sealing the perimeter of said sleeve in said opening adjacent an open end of said sleeve; mounting on a bracket assembly means a lamp socket secured to and bridging spaced legs of a biaxial lamp; inserting into said sleeve the biaxial lamp, oriented with the socket at the open end of the sleeve, and mounting said bracket assembly means on said inner wall.

13. The method of claim 12 wherein the step of mounting a lamp socket includes forcing one leg of a resilient, U-shaped clip over said lamp socket between said biaxial lamp legs and another leg of said clip over a bracket plate of said bracket assembly means.

14. The method of assembling an explosion-proof fluorescent fixture comprising first fastening an end housing to one end of a module, said end housing having inner and outer walls detaining a chamber and openings in said inner and outer walls of a size to admit the passage of a light-transmitting sleeve through them, mounting a light-transmitting sleeve in said inner wall by passing an end of said sleeve through said inner and outer wall openings; sealing the perimeter of said sleeve in said inner opening adjacent an open end of said sleeve; mounting on a bracket assembly means a lamp socket secured to an elongated lamp; inserting into said sleeve the said lamp, oriented with said socket at the open end of said sleeve, and mounting said bracket assembly means on said inner wall.

* * * * *

UNITED STATES PATENT AND TRADEMARK OFFICE

CERTIFICATE OF CORRECTION

PATENT NO. : 4,841,418

DATED : June 20, 1989

INVENTOR(S) : Dwayne Davis

It is certified that error appears in the above-identified patent and that said Letters Patent is hereby corrected as shown below:

On the title page:

Abstract, line 2, delete "annd" and insert -- and --.

Column 4, line 34, delete "appropriately reduced" and insert -- appropriately be reduced --.

Column 6, line 53, delete "size admit" and insert -- size to admit --.

Column 7, line 4, delete "detaining" and insert -- defining --.

Signed and Sealed this

Third Day of July, 1990

*Attest:*

HARRY F. MANBECK, JR.

*Attesting Officer*

*Commissioner of Patents and Trademarks*